United States Patent [19]

Goody

[11] 4,283,712

[45] Aug. 11, 1981

[54] PORTABLE EXERCISE TOTALIZER

[76] Inventor: Roy W. Goody, 281-4 Rio Verde Pl., Milpitas, Calif. 95131

[21] Appl. No.: 753,582

[22] Filed: Dec. 22, 1976

[51] Int. Cl.[3] ..... G08B 5/36; A63B 71/06

[52] U.S. Cl. ..... 340/323 R; 235/92 FQ; 272/70; 340/321

[58] Field of Search ..... 340/323 R, 321, 351, 340/348; 235/92 GA, 92 CA, 92 FQ, 92 DE; 272/70; 324/161; 128/2.1 R, 2.1 A; 364/510, 410, 413

[56] References Cited

U.S. PATENT DOCUMENTS

| | | | |
|---|---|---|---|
| 3,278,727 | 10/1966 | Geis | 235/92 FQ |
| 3,510,633 | 5/1970 | Kintner | 235/92 DE |
| 3,637,996 | 1/1972 | Seymour | 235/92 FQ |
| 3,797,010 | 3/1974 | Adler et al. | 340/323 R |
| 3,882,480 | 5/1975 | Greber | 340/323 R |
| 3,893,099 | 7/1975 | Zoepfl | 340/323 R |
| 4,016,407 | 4/1977 | Mesecar et al. | 235/92 DE |
| 4,048,474 | 9/1977 | Olesen | 235/92 FQ |
| 4,053,879 | 10/1977 | Anderson | 340/348 |

*Primary Examiner*—James J. Groody

*Attorney, Agent, or Firm*—Jack M. Wiseman; Francis W. Anderson

[57] ABSTRACT

A portable exercise totalizer for recording total exercise exertion during an exercise period. The exercise totalizer comprises a pulse generator for producing pulses at various predetermined frequencies. A group of activating switches represent respectively various exercise routines, such as walking, jogging, running, sprinting, and the like. At the beginning of the exercise period, an operator actuates the activating switch representing the exercise routine to be performed during the exercise period. The actuation of the activating switch activates the pulse generator and selects the pulse frequency to be produced by the pulse generator during the exercise period. At the end of the exercise period, the operator actuates a deactivating switch to discontinue the generation of pulses by the pulse generator. The selected frequency for the pulse generator represents the level of exercise exertion performed by the operator during the exercise period. A counter records the accumulated total of exercise exertion for the exercise period, which total is displayed visually. When the operator changes the exercise routine during the exercise period, the operator merely actuates another activating switch representing the other exercise routine to be performed.

20 Claims, 10 Drawing Figures

Fig-1
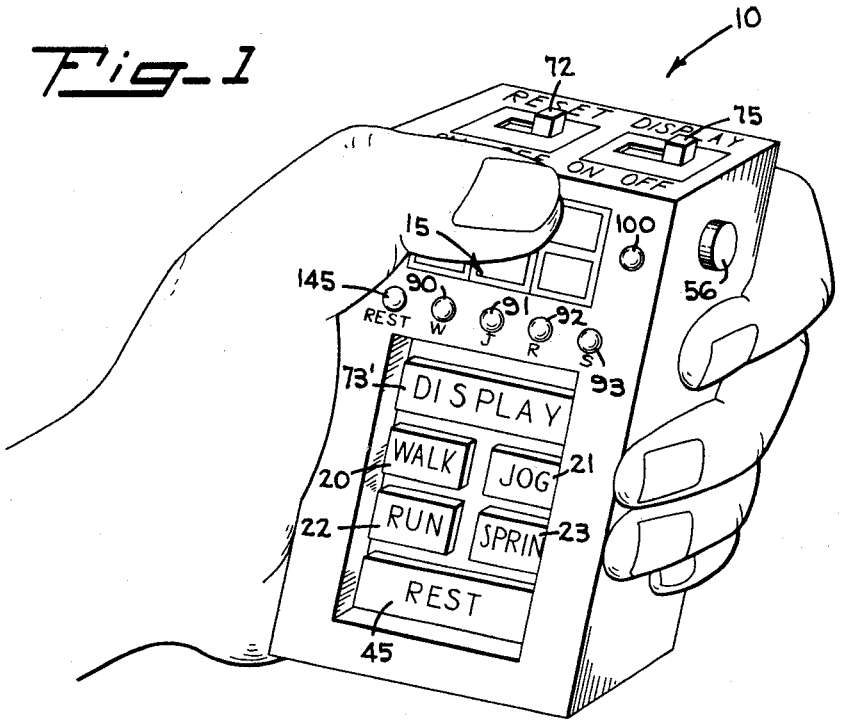
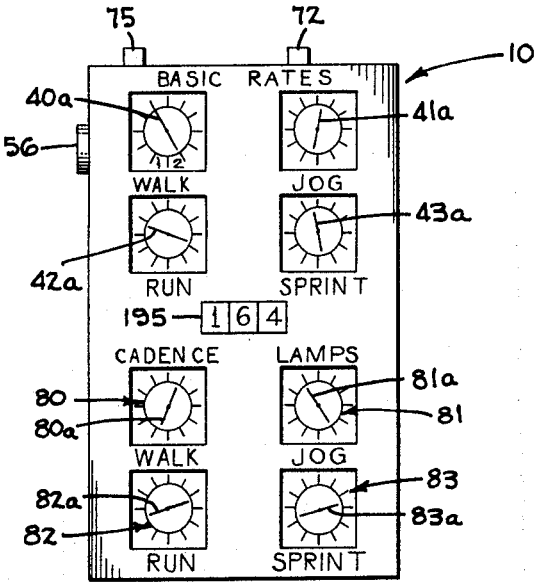
Fig-2

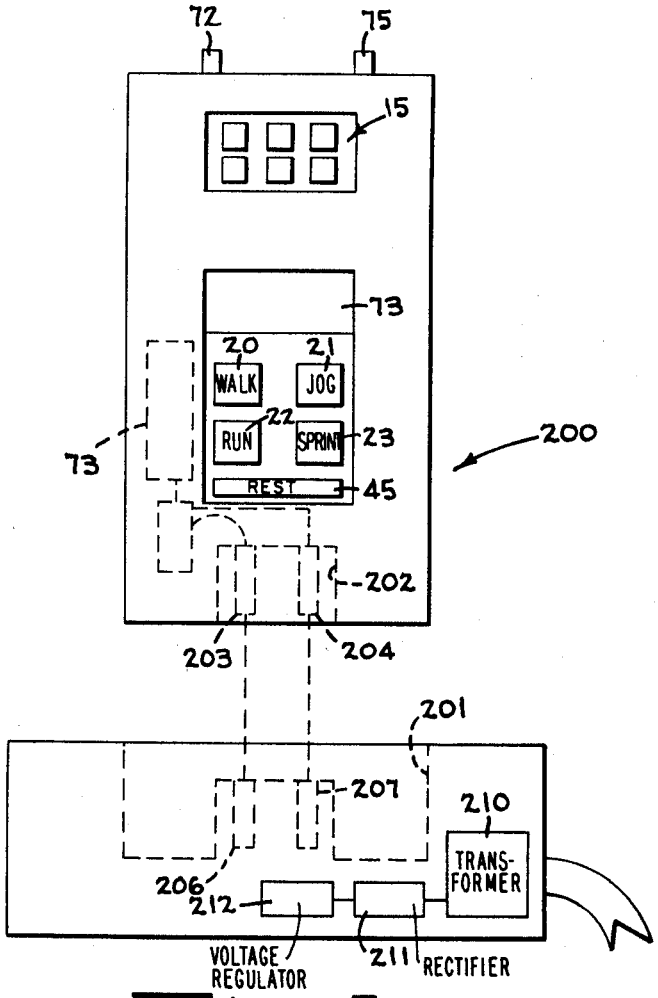
Fig-5
Fig-6
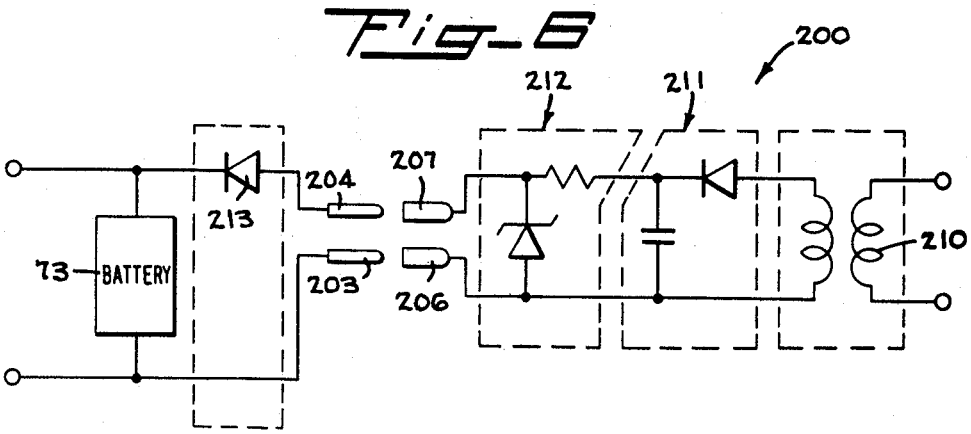

PORTABLE EXERCISE TOTALIZER

BACKGROUND OF THE INVENTION

The present invention relates in general to electronic totalizers, and more particularly to a portable exercise totalizer for recording exercise exertion during an exercise period.

Exercise has been encouraged for good health and to reduce cardio-vascular related diseases. There have been published exercise programs in which a variety of exercises are recommended. Each exercise is designated by points per unit of time in accordance with the exercise exertion attributed thereto. It has been customary for participants to total the accumulated exercise exertion points manually on paper and to refer to charts for the calculation of the total points. Such records were usually kept in a book and recorded at the end of the exercise period.

In the patent to Adler et al. U.S. Pat. No. 3,797,010, issued on May 12, 1974, for Jogging Computer, there is disclosed a jogging computer in which a sensor is attached to the body of the person exercising and produces pulses in response to the motion of the body of the person exercising. A counter counts the pulses and measures the pulse rate. The product of the number of pulses and the pulse rate is integrated over the exercise period. The circuit then compares a preprogrammed schedule with the level of the integral to provide a signal, either visual or audible, to indicate to the person exercising his desired levels of achievement with respect to the preprogrammed schedule.

The patent to Greber U.S. Pat. No. 3,882,480, isued on May 6, 1975, for Contact Pacer Timer, describes a contact pacer timer which produces audible signals to enable a person exercising to set a prescribed pace in jogging, walking or the like. The timing pace is preselected and adjustable by a variably positioned switch controlling the pulse frequency of a pulse generator.

SUMMARY OF THE INVENTION

An exercise totalizer in which a plurality of switches respectively designate different exercise routines. A pulse generator for producing pulses at various predetermined frequencies. The predetermined pulse frequencies represent respectively exercise exertion designated for the different exercise routines. An operator actuates the switch designated for the exercise routine to be performed for activating the pulse generator to produce pulses at a predetermined frequency to correspond to the exercise exertion for the exercise routine to be performed. A counter records the accumulated total of exercise exertion during an exercise period, which total is displayed visually.

By virtue of the present invention, the exercise totalizer permits maximum flexibility and variety in the selection of the various exercise routines for recording the accumulated total of exercise exertion during an exercise period.

An object of the present invention is to provide an exercise totalizer adaptable for recording accumulated points in the carrying out of a point system exercise program.

Another object of the present invention is to provide a portable exercise totalizer in which a count of exercise exertion is self-generated, variable in accordance with the exercise routine, and which displays the accumulated total of exercise exertion during an exercise period.

A feature of the present invention is a circuit that is activated by an operator to reduce the accumulated total of exercise exertion during an exercise period, when the operator rests too often during the exercise period.

Another feature of the present invention is an arrangement for recording a running total of exercise exertion over a plurality of exercise periods.

Another feature of the present invention is an arrangement of recording a projected total of exercise exertion to serve as a goal to be achieved during an exercise period or during a group of exercise periods.

Another feature of the present invention is a visual device for aiding an operator to establish a desired cadence for an exercise routine.

DESCRIPTION OF THE DRAWINGS

FIG. 1 is a diagrammatic front perspective view of the portable exercise totalizer embodying the present invention.

FIG. 2 is a diagrammatic rear elevation view of the portable exercise totalizer shown in FIG. 1.

FIG. 5 is a diagrammatic illustration of the portable exercise totalizer shown in FIGS. 1 and 2 being held on a stand for support and to be recharged.

FIG. 6 is a schematic diagram of a recharging circuit for the portable exercise totalizer shown in FIGS. 1 and 2 when the portable exercise totalizer is held by the support shown in FIG. 5.

DETAILED DESCRIPTION OF THE PREFERRED EMBODIMENTS

Illustrated in FIGS. 1 and 2 is the portable exercise totalizer 10 embodying the present invention, which is of a size that is readily carried in the hand of an operator. The portable exercise totalizer 10 records total exercise exertion during an exercise period, which is displayed, in the exemplary embodiment, by a conventional and well-known liquid crystal display 15 (FIGS. 1, 3, and 4A).

Figure 3:
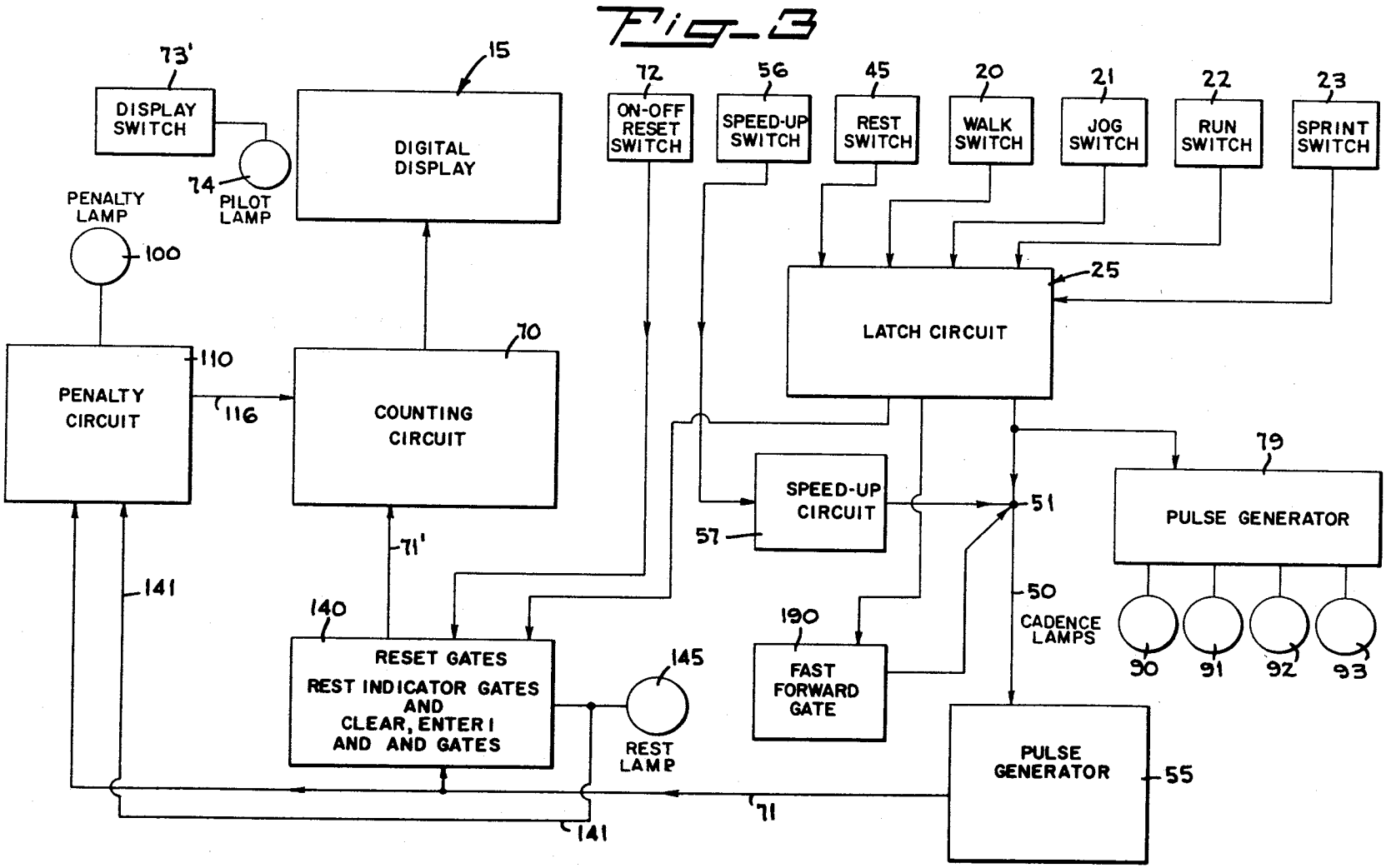
FIG. 3 is a block diagram of the circuit employed in the portable exercise totalizer shown in FIGS. 1 and 2.
Figure 4A:
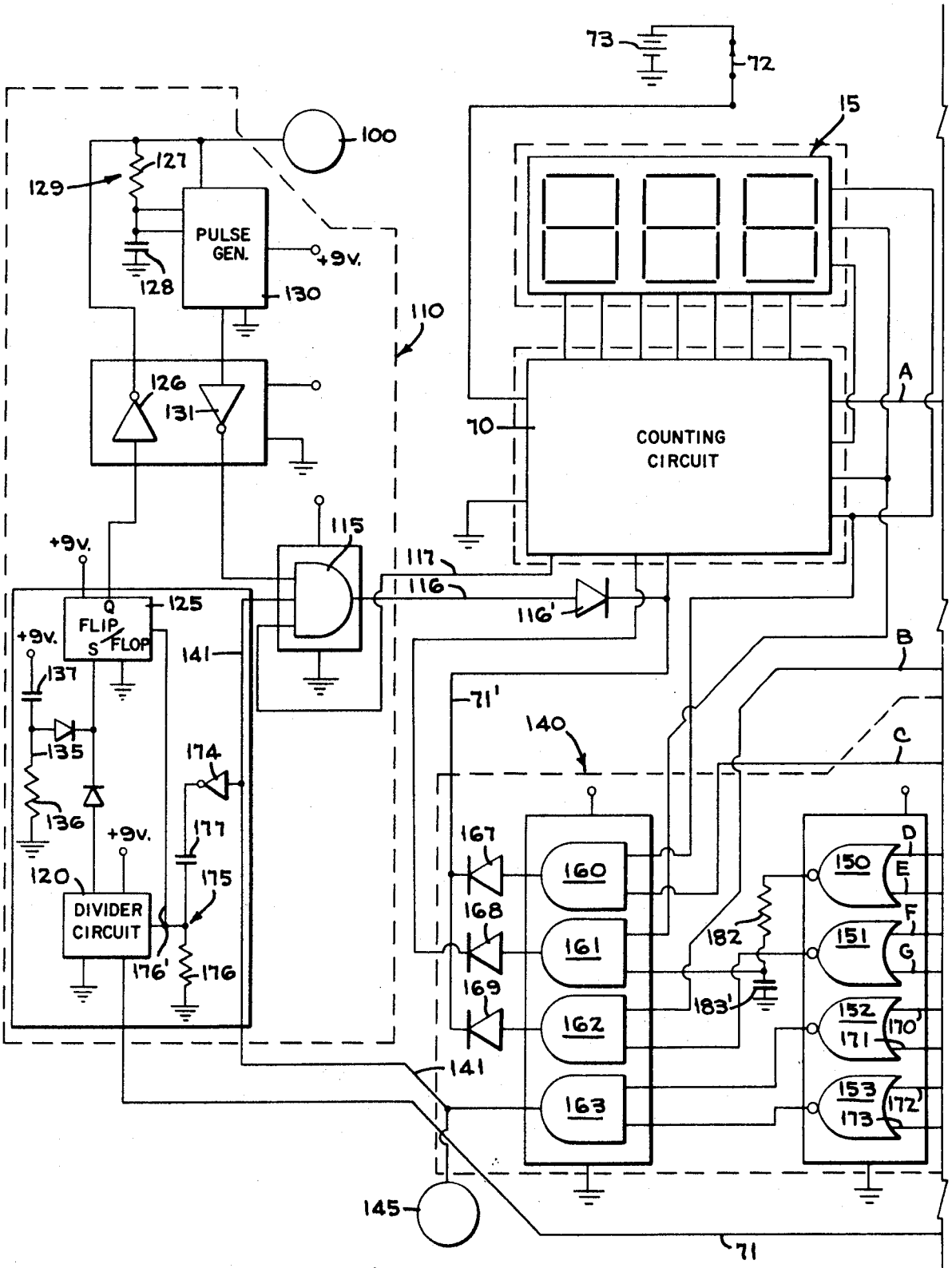
FIGS. 4A–4C, when placed side-by-side, are a schematic diagram of the circuit shown in FIG. 3.
Figure 4B:
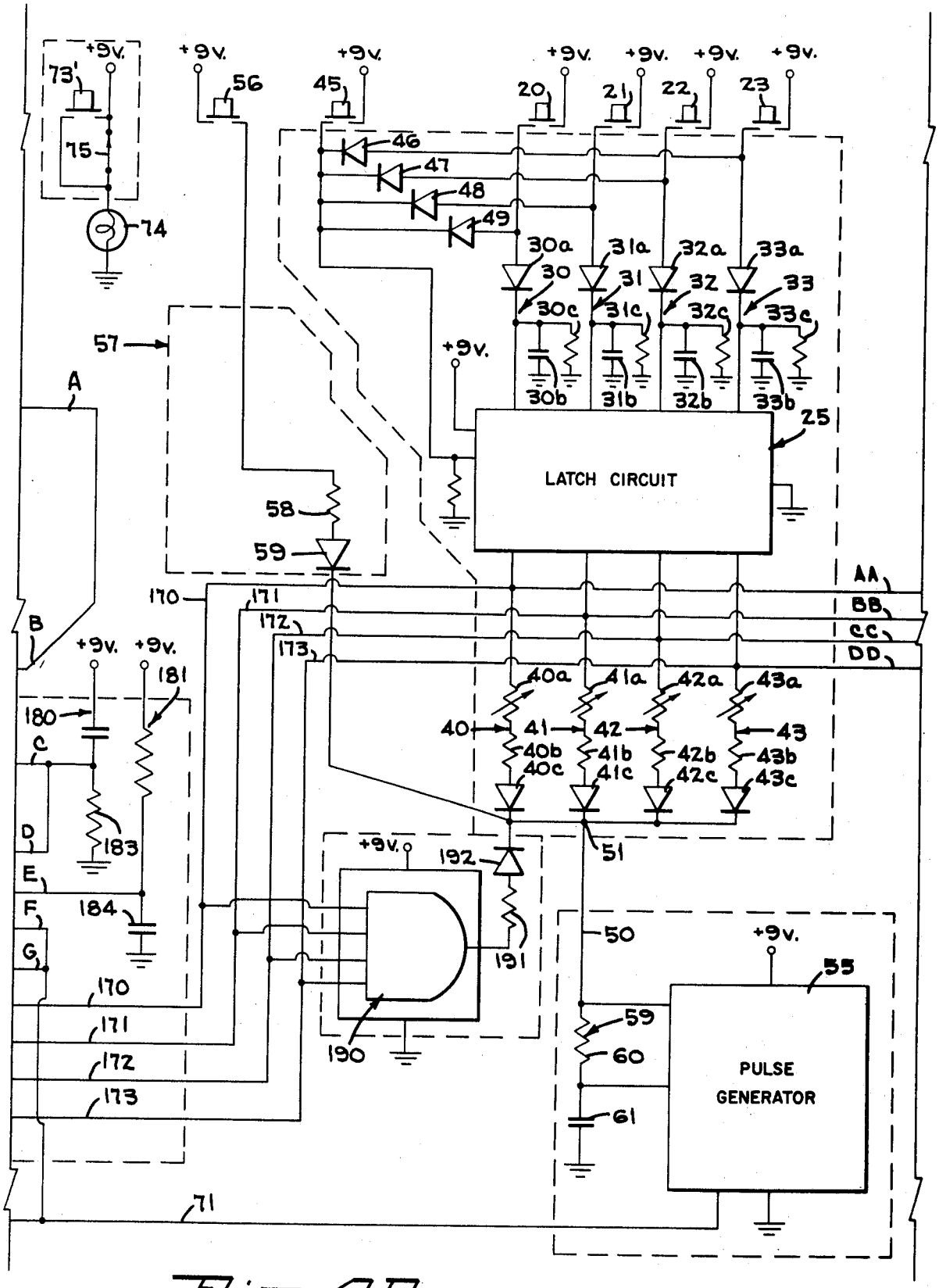

Included in the portable exercise totalizer 10 are suitable activating switches or keys 20–23 (FIGS. 1, 3, and 4B). The switches 20–23 represent, respectively, various exercise routines which, in the exemplary embodiment, are walking, jogging, running and sprinting. Connected to the switches 20–23 to be activated thereby is a conventional quad "D" latch circuit 25 (FIGS. 3 and 4B), which is a well-known integrated circuit CD 4042A manufactured by Radio Corporation of America. The latch circuit 25 includes data input circuits 30–33 (FIG. 4B), which are selected by the actuation of the switches 20–23, respectively. Also included in the latch circuit 25 are data output circuits 40–43, which are activated by the data input circuits 30–33, respectively. The quad "D" latch circuit 25 provides four independently operated latch circuits which represent the activating switches 20–23, respectively.

When one of the switches 20–23 is actuated by an operator, a positive pulse is applied to its associated data input circuit 30–33. The data present in the pulsed data input circuit 30–33 is transferred to its associated data output circuit 40–43. When the actuated switch 20–23 is released, the positive pulse is removed from its associated data input circuit 30–33. A negative going pulse from the data input circuit 30–33 having the positive pulse thereof removed latches in the data present in the associated data output circuit 40–43. When a succeeding positive pulse is applied to a selected data input circuit 30–33 by the actuation of its associated switch 20–23, all data output circuits 40–43 are cleared and the logic states of the data output circuits 40–43 will depend on the new logic states of the data input circuits. When the latching signal again goes negative, the new logic states are latched in.

Since each switch 20–23 represents a different exercise routine, each data input circuit 30–33 represents, when pulsed by a positive signal from its associated switch, data corresponding to the exercise exertion designated for its associated switch 20–23. The data corresponding to the exercise exertion is transferred and latched in the associated data output circuit 40–43. Thus, the selected data output circuit 40–43 stores data corresponding to the exercise exertion designated by the actuated switch 20–23.

Therefore, the data input circuits 30–33 and their associated data output circuits 40–43 are respectively associated with the various exercise routines, such as walking, jogging, running and sprinting. Except for component values representing data, the circuits are similar. Hence, only the walk operation will be described. When the walk switch 20 is actuated, a logic "1" signal is applied to the walk data input circuit 30. As a consequence thereof, a logic "1" signal appears on the walk data output circuit 40. When the walk switch 20 is released, the logic "1" signal is latched into the walk data output circuit 40.

Should an operator desire to change his exercise routine and thus the rate of exercise exertion, he actuates another switch 20–23, such as the running switch 22. In so doing, a logic "1" signal appears at the run data input circuit 32 and the run data output circuit 42. The walk data output circuit 40 returns to ground or to a "0" state. When the run switch 22 is released, the logic "1" signal is latched into the run data output circuit 42.

The data input circuits 30–33, respectively, include diodes **30*a*–33*a*, such as IN 9141 rectifiers (FIG. 4B). Additionally, the data input circuits 30–33 include respectively capacitors 30*b*–33*b* and resistors 30*c*–33*c* connected in parallel to provide respective R-C networks for maintaining the logic "1" state for a fraction of a second after the associated switch 20–23 is released. This assures the data will remain in the data input circuits 30–33** during the latching operation.

The data output circuits 40–43 respectively include variable resistors **40*a*–43*a* (FIGS. 2 and 4B), resistors 40*b*–43*b* (FIG 4B) diodes 40C–43C and a capacitor 61 to provide respective R-C networks through which are applied activating signals. The diodes 40C–43C maintain circuit independence for the data output circuits 40–43, respectively. The variable resistors 40*a*–43*a* permit adjustment by the operator for calibration purposes and for regulating the exercise exertion factor. The variable resistors 40*a*–43*c* are well-known trimming potentiometers. Surrounding the variable resistors 40*a*–43*a*** are suitable scales to aid in the setting of the basic rate calibrations. Each scale is marked off in points per minute.

For discontinuing the application of activating signals from the data output circuits 40–43, a stop-rest deactivating switch 45 (FIGS. 1 and 4B) is actuated. When this occurs, a stop-rest pulse is applied to the "clear" input while all the data input circuits 30–33 are at logic zero, thereby placing the data output circuits 40–43 at a logic "0" state. When the stop-rest deactivating switch 45 is released, the negative pulse into the clear input latches all the data output circuits 40–43 in a logic "0" state. Diodes 46–49 (FIG. 4B) prevent signals from searching the wrong data input circuits 30–33.

Connected to the output circuits 40–43 through a common conductor 50 at a convergence connection 51 is a pulse generator 55 (FIGS. 3 and 4B) in the form of a well-known 555 timer integrated circuit. The pulse generator 55 produces pulses, when an activating voltage is applied thereto, at a repetition rate or frequency commensurate with the data voltage applied thereto through the data output circuits 40–43. The data signal from the data output circuits 40–43 converge at the connection 51 and is conducted over the common conductor 50 for application to the pulse generator 55 over an input circuit 59, which includes a resistor 60, the capacitor 61 and ground. The pulse frequencies of the pulse generator 55 are selected by the values of the variable resistors **40*a*–43*a* and the resistors 40*b*–43*b* along with resistor 60 and capacitor 61. The frequency at which the pulse generator 55 operates is determined by the data output circuits 40–43 in a logic "1" state and the variable resistors 40*a*–43*a* and the resistors 40*b*–43*b* in such circuits. Therefore, the frequency of the pulses produced by the pulse generator 55 is commensurate with the value of the variable resistors 40*a*–43*a* and the resistors 40*b*–43*b* of the data output circuits 40–43** latched in a logic "1" state.

The data output circuits 40–43 are similar except for the specific values of the components thereof. Thus, only the operation of the walk data output circuit 40 will be described. When the walk data output circuit 40 is in a logic "1" state, the data stored in the data output circuit 40 is applied through the variable resistor **40*a*, resistor 40*b* and diode 40*c*. As a consequence thereof, the pulse generator 55 is activated. The pulse generator 55 thereupon produces pulses at a pulse rate or frequency inversely proportional to the value of the resistors 40*a*, 40*b*, and 60. Thus, the output frequency of the pulse generator 55 is commensurate with the exercise exertion for the switch 20**.

To increase the number of available exercise exertion rates, two or more switches 20–23 may be actuated simultaneously. The actuation of two or more switches 20–23 places the associated data output circuits 40–43 in a logic "1" state. Thus, the data signals applied to the pulse generator 55 will be applied thereto through the convergence connection 51 and over the conductor 50. The data signals thus applied will be the sum of the data output signals of the data output circuits 40–43 in a logic "1" state, and the pulse frequency generated by the pulse generator 55 will be the sum of the frequencies requested by the actuated switches 20–23. Hence, the switches 20–23 provide eleven different exercise exertion rates.

Shown in FIGS. 1, 3 and 4B is a speed-up switch 56. Connected to the speed-up switch 56 is a speed-up circuit 57 (FIGS. 3 and 4B) which comprises a resistor 58 and a diode 59 (FIG. 4B). The output of the speed-up circuit 57, in turn, is connected to the convergence connection 51 for application to the pulse generator 55. When the speed-up switch 56 is actuated, additional current flows into the pulse generator 55 through the speed-up circuit 57, convergence connection 51, conductor 50 and the input circuit 59. As a consequence thereof, the pulse rate for the pulse generator 55 is increased. Releasing the speed-up switch 56 discontinues the application of increased voltage to the pulse generator 55 and the pulse generator 55 operates at the previous pulse frequency. Thus, the totalizer 10 is capable of providing twenty-two different exercise exertion rates.

Figure 8:
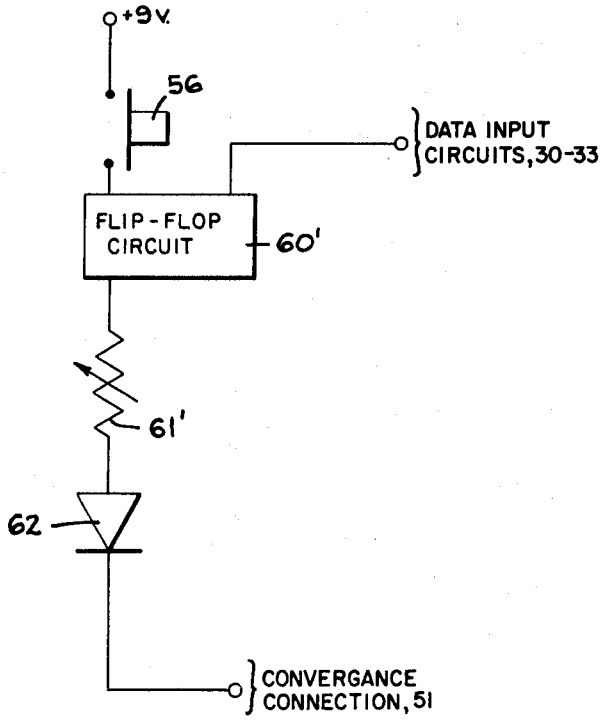
FIG. 8 is a schematic diagram of a modification of the speed-up circuit employed in the portable exercise totalizer of the present invention.

Illustrated in FIG. 8 is a modification of the speed-up circuit 57, which has added to it a flip-flop circuit 60'. The speed-up switch 56 is connected to the "set" side and the data input circuits 30–33 of the latch circuit 25 are connected to the "reset" side. The output of the flip-flop circuit 60' is connected to a variable resistor 61' and a diode 62. The output speed-up voltage is conducted to the convergence connection 51 over the conductor 50 for application to the pulse generator 55. Thus, the speed-up voltage is constantly applied to the pulse generator 55 until a reset signal is applied to the flip-flop circuit by actuating one of the switches 20–23.

For counting the pulses produced by the pulse generator 55, a suitable counting circuit 70 (FIGS. 3 and 4A) is connected to the output of the pulse generator circuit 55 through an AND gate 162 and over a conductor 71'. The counting circuit 70 is a well-known MM 5736N calculator chip integrated circuit manufactured by National Semiconductor of Santa Clara, Calif. By virtue of the counter circuit 70, the space requirements of the portable exercise totalizer 10 are reduced to the extent that the totalizer can be held in the hand of an operator. The operation of an MM 5736 calculator chip has been described in Part I of an article entitled "Build This Electronic Stopwatch" by Tommy N. Tyler, appearing in the November 1975 issue of "Radio-Electronics".

The output of the counting circuit 70 is applied to the liquid crystal display 15 for displaying the total exercise exertion during an exercise period. The liquid crystal display 15 includes three seven-segment liquid crystal decimal read-outs. In a similar manner, seven output conductors (FIG. 4A) from the counting circuit 70 may provide data information to each of seven-segment light-emitting diodes, not shown, should light-emitting diodes be desired. It is within the contemplation of the present invention that the output of the counting circuit 70 be connected to well-known light-emitting diodes, which may be part of a counting and display circuit. In such event, suitable driver circuits, such as a 75492 integrated circuit, may be interposed between the display circuit and the counting circuit.

The internal logic of the counting circuit 70 is such that, when one of the six multiplexing outputs is applied to one of the three data input circuits, the counting circuit 70 reads this action as a given command. For example, the command to clear, enter 1, add and subtract are read by the counting circuit 70. An AND gate is disposed between a given multiplex output and a given data input. When the AND gate is enabled, the command is issued. The pulses produced by the pulse generator 55 repeatedly enable the AND gate 162 (FIG. 4A) to issue the "ADD" command, which pulses are gated through a NOR gate 151.

However, before the counting circuit 70 adds, it must first be cleared to zero and a "1" entered in its internal register and displayed. This is accomplished by a combination of RC timing circuits 180 and 181 (FIG. 4B) and a NOR gate 150. Resistor 182 and capacitor 183' provide a short time delay so that the clear and enter 1 commands do not occur simultaneously.

When an on/off reset switch 72 (FIGS. 1, 2 and 4A) is turned "on", voltage is applied to RC timing circuits 180 and 181. In the RC timing circuit 180, the output is taken from a resistor 183 and, in the RC timing circuit 181, the output is taken from a capacitor 184. Therefore, one signal rises quickly and then falls to zero, while the other rises slowly toward the applied potential. Chronologically, the quickly rising signal enables an AND gate 160 (FIG. 4A) that controls the CLEAR command and the liquid crystal display 15 reads zero for an instant. The quickly rising signal is also applied to the two-input NOR gate 150 to disable the NOR gate 150. The quickly rising signal soon falls to disable the AND gate 160 of the clear circuit.

Since the slowly rising signal has not reached its threshold voltage, its output is applied to the same NOR gate 150 to be enabled for an instant. The output of the NOR gate 150 is applied to an AND gate 161 that controls the ENTER 1 command and a "1" appears on the first seven-segment display of the liquid crystal display 15. Thereupon, the slowly rising signal disables the NOR gate 150 by a logic "1" to one of its inputs, and the counter circuit 70 is ready to receive its first pulse from the pulse generator 55. The pulses are applied to the AND gate 162 that controls the "ADD" command through the NOR gate 151. Thus, the counting pulses for the "ADD" command go through the NOR gate 151, through the AND gate 162 and are applied to the counting circuit 70 over the conductor 71'.

The driver/multiplexer/counter/debouncer for up to six seven-segment display devices is a conventional technique fully disclosed in National Semiconductor's application note AN-112, "Calculator Chip Makes A Counter". An article of interest in this regard is "Build This Electronic Stopwatch" by Tommy N. Tyler, Part II, appearing in February 1976 issue, pages 57–59 of "Radio Electronics".

The closing of the on-off reset switch 72 applies the operating potentials to the circuitry of the portable exercise totalizer 10 through a battery 73. The opening of the on-off reset switch 72 clears all memory registers and also clears and resets the liquid crystal display 15. A display switch 73' (FIGS. 1 and 4B) is connected to a conventional pilot light lamp 74 to provide independent external illumination for the liquid crystal display 15 as long as it is depressed. For continuation illumination, a switch 75 may be actuated.

Figure 4C:
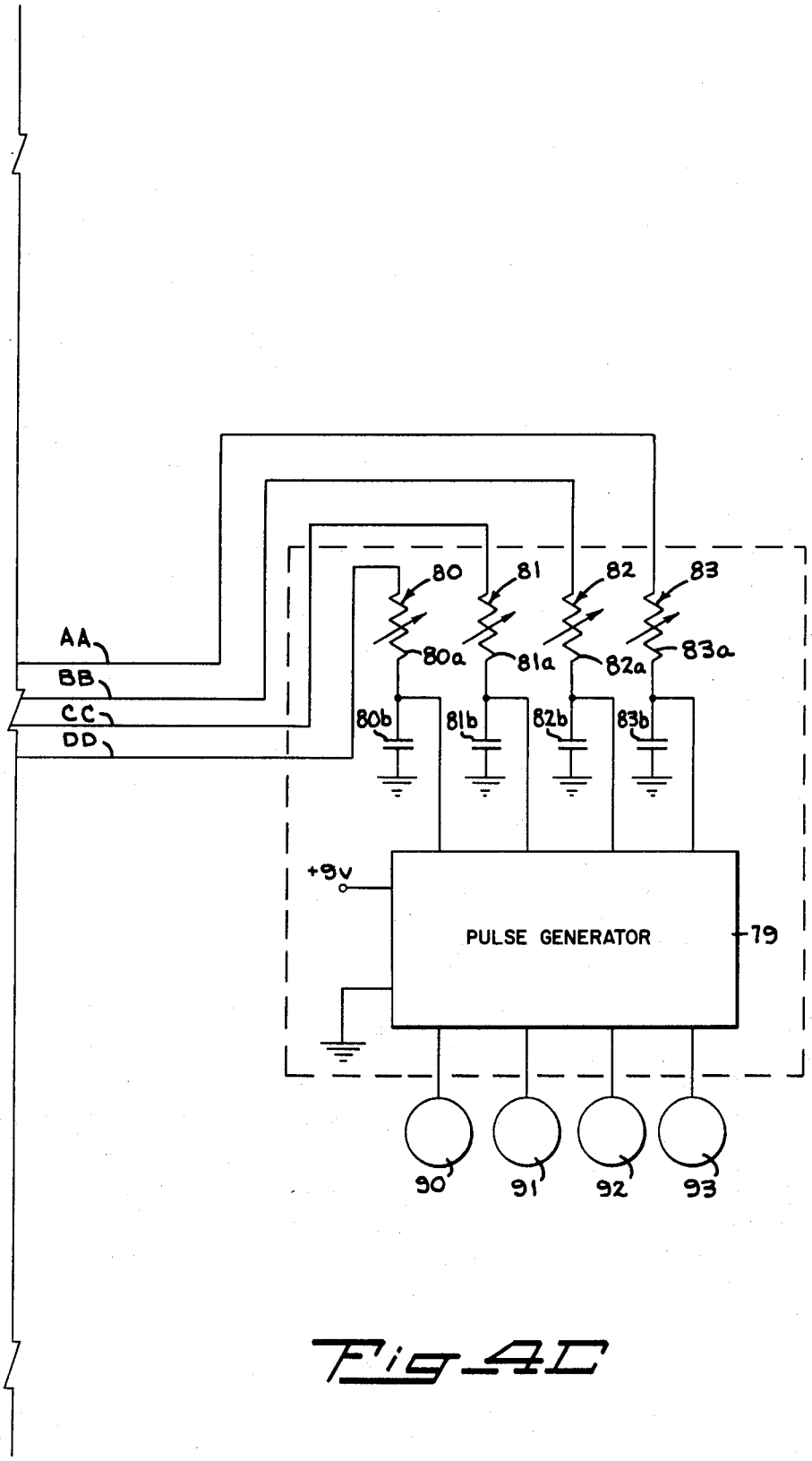

To enable an operator to set an exercise rate or cadence commensurate with the pulse rate output of the pulse generator 55, a pulse generator 79 (FIGS. 3 and 4C) is connected to the output of the latch circuit 25 through RC time circuits 80–83 (FIG. 4C). The pulse generator 79 is in the form of a quad 555 timer integrated circuit. The RC time circuits 80–83 of the pulse generator 79 are connected respectively to the output of the latch circuit 25 to be connected, respectively, to the data input circuits 30–33 of the latch circuit 25. The RC time input circuits 80–83 include variable resistors 80*a*–83*a* (FIGS. 2 and 4C) and capacitors 80*b*–83*b*. Connected to the output of the pulse generator 79 are lamps 90–93 (FIGS. 2, 3 and 4C) which, in the exemplary embodiment, are light-emitting diodes. Suitable cadence scales (FIG. 2) aid in the setting of the cadence, which surround the variable resistors 80*a*–83*a*. The scales are marked off in pulses per minute. The variable resistors 80–83 are well-known trimming potentiometers.

The lamps 90–93 correspond with the switches 20–23, respectively, and are associated with the input circuits 30–33, respectively. Hence, the lamps 90–93 can be labeled walking, jogging, running and sprinting. The respective output circuits of the latch circuit 25 are either in a high voltage state or a low voltage state, dependent on which ones of the activating keys 20–23 are actuated. Each output is connected to one of the four independent pulse generators of the quad 555 timer pulse generator 79 to excite at a repetitious pulse rate the cadence lamp 90–93 associated with the actuated switches 20–23. When the walking switch 20 is actuated, the walking lamp 90 is excited. When the jogging switch 21 is actuated, the jogging lamp 91 is excited. Similarly, when the running switch 92 is actuated, the running lamp 92 is illuminated. When the sprinting switch 23 is actuated, the sprinting lamp 93 is illuminated. The lamps 90–93, when excited, will be illuminated in a pulsating on-off mode at a repetition rate controlled by the associated pulse generator of the quad 555 timer pulse generator 79. The repetition rate of glow flickers or pulsations by the lamps 90–93 can be varied by adjusting the variable resistors 80*a*–83*a*, respectively. The repetition rates of the output pulses produced by the independent pulse generators of the quad 555 timer pulse generator 79 are controlled by the input RC timing circuits 80–83, respectively.

Thus, each lamp 90–93 provides a visual signal to the operator that the totalizer 10 has properly latched into the desired mode of operation and provides a visual timing signal that can be used to determine how the current exercise cadence compares to a preset calibrated rate.

Should an operator rest too frequently so that an insufficient number of points have been earned between rests, a lamp 100 (FIGS. 1, 3 and 4A) is illuminated. When one or more of the switches 20–23 is actuated, the penalty lamp 100 is illuminated and remains illuminated for a predetermined period of time or until a prescribed number of points has been earned. Subsequent thereto, the lamp 100 is extinguished.

Should the operator actuate the rest switch 45 while the penalty lamp 100 is on, the counting circuit 70 will subtract points at a preset pulse rate, thus subtracting points from the total points earned up to this time. Once the penalty lamp 100 is extinguished, no points will be subtracted when the rest switch 45 is again activated.

Toward this end, a penalty circuit 110 (FIGS. 3 and 4A) includes an AND gate 115 (FIG. 4A), which is a three input AND gate. All inputs of the AND gate 115 must be enabled to produce an output signal. The output of the AND gate 115 is connected to the counting circuit 70 over a conductor 116 and through a diode 116' to control the subtract command of the counting circuit 70. The subtract operation for the counting circuit 70 is similar to that previously described for the other counting circuit 70 commands, such as "ADD" command.

All of the inputs of the AND gate 115 must be enabled in order to initiate the subtract command in the counting circuit 70. One of the inputs of the AND gate 115 is connected to the counting circuit 70 over a conductor 117 for the subtract command operation with the counting circuit 70. The other two input circuits of the AND gate 115 provide the enable or disable operation for the AND gate 115. The pulse generator 55 is connected to a divide-by-eight circuit 120 (FIG. 4A) over the conductor 71. The output of the divide-by-eight circuit 120 is connected to a RS flip-flop circuit 125 to set the same. The divide-by-eight circuit 120, in the exemplary embodiment, is an integrated circuit CD 4022 manufactured by Radio Corporation of America, and the RS flip-flop circuit 125, in the exemplary embodiment, is an integrated circuit manufactured by Radio Corporation of America.

The penalty circuit 110 operates in the following manner. When power is applied to the totalizer 10 by activation of the on/off reset switch 72 (FIGS. 1, 2 and 4A), a differentiator circuit 135, consisting of resistor 136 and capacitor 137, sends a pulse to the set input of the RS flip-flop circuit 125, whereupon the output of the RS flip-flop circuit 125 goes to a logic "1" state. This logic "1" state is inverted by an inverter circuit 126 and the resulting logic "0" state deactivates a pulse generator 130. The pulse generator 130, in the exemplary embodiment, is a well-known 555 timer integrated circuit. Additionally, the penalty lamp 100, also driven through the inverter circuit 126, is off. The differentiator circuit 135, therefore, prevents the penalty circuit 110 from initiating the subtraction mode when power is first applied.

When one or more of the activating keys 20–23 are activated, the following reset sequence is initiated. The rest indicator lamp 145 goes out. The rest indicator lamp 145 is driven by an AND gate 163 which, in turn, is driven by NOR gates 152–153 which are connected to the data output circuits 40–43 by way of conductors 170–173. AND gate 163 and NOR gates 152–153 are equivalent to a four-input NAND gate and are used because the gates are available as part of the reset gates, rest indicator gates, and add gates circuit 140. The NOR gates 150–153 are, in the exemplary embodiment, CD 4001A integrated circuits manufactured by Radio Corporation of America, and the AND gates 160–163 are, in the exemplary embodiment, CD 4081B integrated circuits manufactured by Radio Corporation of America. Therefore, when any of the activating keys 20–23 are activated, one or more logic "1" states are presented to NOR gates 152–153 and the rest indicator lamp 145 goes out. The resulting negative-going pulse from rest indicator lamp 145 is sent through a conductor 141, inverted by an inverter circuit 174 and the positive-going pulse sent to differentiator circuit 175, consisting of resistor 176 and capacitor 177. The resulting positive pulse from differentiator circuit 175 resets the divide-by-eight circuit 120 to the zero state and also resets flip-flop circuit 125 to the logic "0" state over a conductor 176'. The output of inverter circuit 126 is therefore at the logic "1" state and activates pulse generator 130 which sends pulses to AND gate 115. The inverter circuits 126, 131, and 174 are, in the exemplary embodiment, integrated circuits of the CD 4069B manufactured by Radio Corporation of America. AND gate circuit 115 is, in the exemplary embodiment, integrated circuit CD 4073B manufactured by Radio Corporation of America. AND gate 115, however, is disabled by the logic "0" state of the rest indicator lamp 145 through conductor 141, and the subtraction pulses are not received by the counting circuit 70.

Since the activation of one or more of the activating keys 20–23, the pulse generator 55 sends pulses to the divide-by-eight circuit 120 over the conductor 71. When the rest key 45 is activated, the penalty circuit 110 will go into one of two possible states, depending on the receipt of greater than or fewer than eight pulses by the divide-by-eight circuit 120 over conductor 71.

If fewer than eight pulses have been received by the divide-by-eight circuit 120, the output states of both the divide-by-eight 120 and the RS flip-flop circuit 125 remain unchanged in the same state as following the reset sequence previously described. The output of inverter circuit 126 is in the logic "1" state and pulse generator 130 is sending subtract pulses to AND gate 115 through inverter circuit 131. If, at this time, the rest key 45 is activated, the rest indicator lamp 145 is illuminated and a logic "1" is sent to AND gate 115 over conductor 141. AND gate 115 is therefore enabled and subtract commands are received by counting circuit 70. Points are therefore subtracted from liquid crystal display 15 at a rate determined by resistor 127 and capacitor 128 of a timing circuit 129 connected to the pulse generator 130. Additionally, penalty lamp 100 remains illuminated by the logic "1" output of the inverter circuit 126. Thus, since insufficient time was allowed between rest periods, the penalty circuit 110 was activated and points were subtracted from the total. When any of the activating keys 20–23 are activated, the rest indicator lamp 145 will go out and AND gate 115 will be deactivated. Additionally, the divide-by-eight circuit 120 will be reset by the differentiator circuit 175 in the manner previously described.

If more than eight pulses have been received by the divide-by-eight circuit 120 since last reset, the penalty circuit 110 will be deactivated in the following manner. Upon receipt of the eighth pulse, the output of the divide-by-eight circuit 120 will go to a logic "1" state and thereby set the output of the RS flip-flop circuit 125 to the logic "1" state, producing a logic "0" at the output of the inverter 126 and deactivating pulse generator 130. When the rest key 45 is pressed and the rest indicator lamp 145 is illuminated, no pulses will be sent through AND gate 115 and the subtraction sequence will be inhibited. Additionally, penalty lamp 100 will be extinguished upon receipt of the eighth pulse thereby signaling that sufficient time has passed since the last rest period in order to avoid the penalty action when the next rest period is taken. As before, when the rest indicator lamp 145 is extinguished, the penalty circuit 110 will be reset.

The output of the latch circuit 25 is connected to a fast forward AND gate 190 (FIGS. 3 and 4B) over the conductors 170–173. When the switches 20–23 are actuated simultaneously, the AND gate 190 is activated. The signal applied to the pulse generator 55 through the connection 51 and the conductor 50 is increased by the output of the AND gate 190 applied to the output of the data output circuits 40–43 through a resistor 191 and a diode 192. As a consequence thereof, the pulse generator 55 increases its pulse rate, thus allowing the exercise totalizer 10 to set the liquid crystal display 15 rapidly to a desired reading.

A manually operated scale 195 (FIG. 2), in the form of a rotatable thumbwheel-type scale, enables an operator to keep an accumulated score over an extended number of exercise periods.

Illustrated in FIG. 5 is an a.c. adapter and support 200 for the exercise totalizer 10. The support 200 includes a recessed area 201 conforming to the shape of the lower extremity of the totalizer 10 to accommodate the totalizer 10 for seating therein. The lower portion of the totalizer 10 includes a well 202 in which extends prongs 203 and 204. Contained within the totalizer 10 is the suitable source of energy, such as the nickel cadmium batteries 73.

Disposed in the recess 201 are sockets 206 and 207 for receiving the prongs 203 and 204, respectively. A source of a.c. power is supplied to a conventional step-down transformer 210 (FIG. 6). The output of the transformer 210 is connected to a peak rectifier circuit 211. A voltage regulator 212 is connected to the output of the rectifier circuit 211. Thus, the placement of the totalizer 10 in mating relation with the support 200 serves to recharge the nickel-cadmium batteries 73. A diode 213 is connected between the prong 204 and the nickel-cadmium battery 73.

Figure 7:
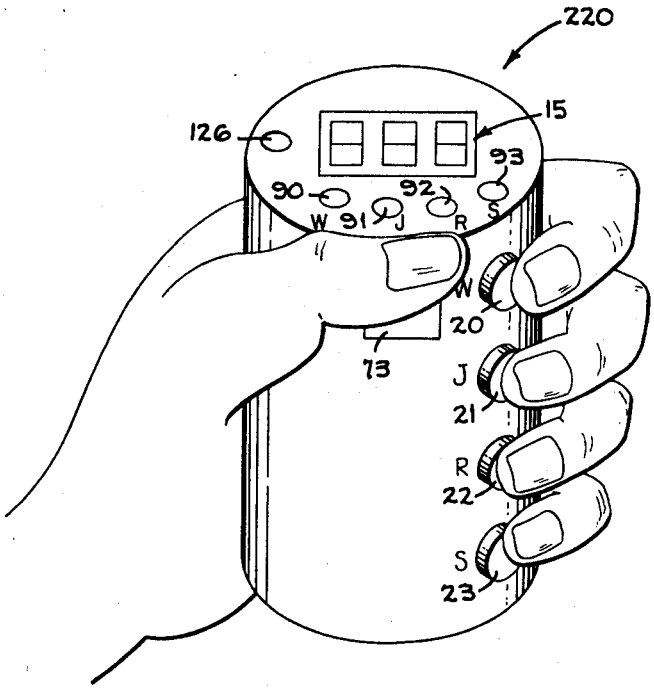
FIG. 7 is a diagrammatic front perspective view of a modification of the portable exercise totalizer shown in FIGS. 1 and 2.

Illustrated in FIG. 7 is a modification of the totalizer 10. The modified portable exercise totalizer 220 has a cylindrical configuration to be easily gripped by an operator. The display 15 is now located on the top end for easy viewing. The switches 20–23 are easily actuated while the totalizer 220 is carried.

I claim:

1. An exercise totalizer comprising:

(a) a plurality of activating switches representing various exercise routines of different degrees of exercise exertion;

(b) a pulse generator for producing pulses at different preselected frequencies corresponding to the different degrees of physical exertion represented by the respective activating switches;

(c) a first circuit interconnecting said activating switches and said pulse generator for exciting said pulse generator in response to the actuation of one or more of said activating switches to generate pulses at a preselected frequency corresponding to the physical exertion represented by the actuated one or more of said activating switches;

(d) a deactivating switch connected to said first circuit for interrupting the generation of pulses by said pulse generator; and (e) a second circuit including a visual display connected to said pulse generator for receiving the pulses generated thereby between the actuation of one or more of said activating switches and the actuation of said deactivating switch for displaying the accumulated total representing the exercise exertion between the exercise period of actuating one or more activating switches and the actuation of the deactivating switch.

2. An exercise totalizer as claimed in claim 1 wherein said first circuit comprises a latch circuit, said latch circuit having a plurality of data input circuits connected to said activating switches respectively for receiving signals representing the degrees of physical exertion represented by the respective actuated one or more of said activating switches; and a plurality of data output circuits corresponding respectively to said data input circuits and connected to said pulse generator for storing respectively the signals received by said data input circuits for producing signals corresponding to the degrees of physical exertion represented by the respective actuated one or more of said activating switches for exciting said pulse generator to generate pulses at a preselected frequency corresponding to the physical exertion represented by the actuated one or more of said activating switches.

3. An exercise totalizer as claimed in claim 2 wherein said deactivating switch is connected to said data input circuits and initiates a deactivating signal when actuated which is received by said data input circuits and stored in the corresponding data output circuits for interrupting the generation of pulses by said pulse generator.

4. An exercise totalizer as claimed in claim 3 wherein said first circuit includes a convergence connection interconnecting said data output circuits and said pulse generator for exciting said pulse generator with a signal representing the total magnitude of the exciting signals in said data output circuits to generate pulses at a preselected frequency corresponding to the physical exertion represented by the actuation of one or more of said activating switches.

5. An exercise totalizer as claimed in claim 4 and including means in each of said data output circuits adjustable for regulating the magnitude of the exciting signal stored therein respectively for varying the frequency of the pulses generated by said pulse generator.

6. An exercise totalizer as claimed in claim 2 and comprising:

(a) a plurality of cadence lamps, there being a cadence lamp to represent each of said activating switches; and (b) cadence circuit means interconnecting said latch circuit and said cadence lamps for operating the cadence lamp associated with an actuated activating switch at a preselected pulsating rate.

7. An exercise totalizer as claimed in claim 6 wherein said cadence circuit means comprises a plurality of data input circuits connected to the output of said latch circuit for storing respectively the signals received by said data input circuits of said latch circuit from one or more actuated activating switches for producing signals corresponding to the degrees of physical exertion represented by the respective actuated activating switches, and a pulse generator connected to said data input circuits of said cadence circuit and said cadence lamps for producing pulses to operate the cadence lamp associated with an actuated activating switch at a preselected pulsating rate.

8. An exercise totalizer as claimed in claim 7 and including means in each of said data input circuits for said cadence circuit adjustable for regulating the magnitude of the signal stored therein, respectively, for varying the frequency of the pulses generated by said pulse generator for said cadence circuit.

9. An exercise totalizer as claimed in claim 1 wherein said second circuit includes a counting circuit connected to said pulse generator and connected to said visual display for receiving the pulses generated by said pulse generator to operate said visual display for displaying the accumulated total representing the exercise exertion during the exercise period.

10. An exercise totalizer as claimed in claim 9 wherein said counting circuit adds and subtracts, said totalizer comprising a penalty circuit connected to said pulse generator to receive pulses therefrom for counting a predetermined number of pulses and connected to said counting circuit for controlling the subtraction operation thereof, and a deactivation circuit connected to said first circuit and said penalty circuit and responsive to the actuation of said deactivating switch within said predetermined number of pulses for establishing a subtraction operation in said counting circuit to reduce the accumulated total displayed by said visual display.

11. An exercise totalizer as claimed in claim 10 wherein said penalty circuit comprises:

(a) a control circuit having its output connected to said counting circuit for controlling the subtraction operation thereof;

(b) a penalty time counting circuit connected to one input of said control circuit to enable said control circuit to conduct during said predetermined number of pulses; and (c) a count initiating circuit connected to the output of said pulse generator and connected to said penalty time counting circuit for initiating said predetermined number of pulses (d) said deactivating circuit being connected to another input of said control circuit for operating said control circuit to establish a subtraction operation in said counting circuit to reduce the accumulated total displayed by said visual display in response to the actuation of said deactivating switch during said predetermined number of pulses.

12. An exercise totalizer as claimed in claim 11 wherein said control circuit is a gate circuit, said penalty time counting circuit is a pulse generator with a time delay circuit, the subtraction operation of said counting circuit being responsive to the pulse frequency of said pulse generator of said penalty circuit for reducing the accumulated total displayed by said visual display at a preselected time rate, and said penalty time counting circuit including a frequency divider circuit connected to said first-mentioned pulse generator and a flip-flop circuit connected to the output of said frequency divider circuit and the input of said pulse generator for said penalty circuit.

13. An exercise totalizer as claimed in claim 10 and comprising a penalty lamp connected to said penalty circuit to be illuminated during said predetermined period of time.

14. An exercise totalizer as claimed in claim 11 and comprising a penalty lamp connected to said count initiating circuit to be illuminated during said predetermined period of time.

15. An exercise totalizer as claimed in claim 10 wherein the actuating of one or more of said activating switches returns said counting circuit to an adding operation for displaying the accumulated total by said visual display.

16. An exercise totalizer as claimed in claim 11 wherein the actuating of one or more of said activating switches returns said counting circuit to an adding operation for displaying the accumulated total by said visual display.

17. An exercise totalizer as claimed in claim 4 and comprising a speed-up switch and a speed-up circuit connected to said convergence connection for increasing the magnitude of the exciting signal applied to said pulse generator to increase the pulse frequency generated by said pulse generation in response to the actuation of said speed-up switch.

18. An exercise totalizer as claimed in claim 1 and comprising a speed-up switch and a speed-up circuit connected to said first circuit for increasing the magnitude of the exciting signal applied to said pulse generator to increase the pulse frequency generated by said pulse generator in response to the actuation of said speed-up switch.

19. An exercise totalizer as claimed in claim 1 and comprising a fast forward circuit connected to said first circuit and said pulse generator and responsive to the simultaneous actuation of said activating switches for increasing the pulse frequency generated by said pulse generator to set said visual display rapidly to a desired accumulated total.

20. An exercise totalizer as claimed in claim 4 and comprising a fast forward circuit connected to said convergence connection and responsive to the simultaneous actuation of said activating switches for increasing the pulse frequency generated by said pulse generator to set said visual display rapidly to a desired accumulated total.

* * * * *